US007749331B2

(12) United States Patent
Becker et al.

(10) Patent No.: US 7,749,331 B2
(45) Date of Patent: Jul. 6, 2010

(54) USE OF POLYMERS FOR MODIFYING SURFACES IN CLEANING APPLICATIONS

(75) Inventors: Heike Becker, Mannheim (DE); Kai-Uwe Baldenius, Heidelberg (DE); Markus Hartmann, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 354 days.

(21) Appl. No.: 11/574,988

(22) PCT Filed: Sep. 12, 2005

(86) PCT No.: PCT/EP2005/009788

§ 371 (c)(1),
(2), (4) Date: Mar. 9, 2007

(87) PCT Pub. No.: WO2006/029793

PCT Pub. Date: Mar. 23, 2006

(65) Prior Publication Data

US 2008/0032911 A1 Feb. 7, 2008

(30) Foreign Application Priority Data

Sep. 13, 2004 (DE) ..... 10 2004 044 605

(51) Int. Cl.
*B08B 3/04* (2006.01)
*C11D 3/37* (2006.01)
*C11D 1/00* (2006.01)

(52) U.S. Cl. ..... 134/25.2; 134/25.3; 134/39; 134/42; 510/197; 510/199; 510/238; 510/243; 510/475; 510/499

(58) Field of Classification Search ..... 510/197, 510/199, 238, 243, 475, 499; 134/25.2, 25.3, 134/39, 42
See application file for complete search history.

(56) References Cited

U.S. PATENT DOCUMENTS 3,251,778 A 5/1966 Dickson et al.
3,650,963 A * 3/1972 Werdehausen et al ..... 510/303
2005/0209117 A1 * 9/2005 Friedrich et al. ..... 510/175

FOREIGN PATENT DOCUMENTS

| | | |
|---|---|---|
| DE | 18 16 280 | 7/1970 |
| DE | 198 59 777 | 6/2000 |
| DE | 101 60 993 | 6/2003 |
| WO | 96 04358 | 2/1996 |
| WO | 97 40087 | 10/1997 |
| WO | 04 001099 | 12/2003 |
| WO | WO 04/001099 | * 12/2003 |

* cited by examiner

*Primary Examiner*—Brian P Mruk
(74) *Attorney, Agent, or Firm*—Oblon, Spivak, McClelland, Maier & Neustadt, L.L.P.

(57) ABSTRACT

The present application relates to the use of formulations comprising a) at least one polymer as component A comprising at least one structural unit of the formula (I)

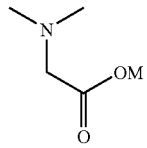

(I)

where the structural unit may be part of a polymer main chain or may be bonded to a polymer main chain via an anchor group, and M is hydrogen or a metal cation;

and water;

for the treatment of hard surfaces as compositions for improving the run-off behavior of water from the treated hard surfaces and for reducing soil and salt deposition on the treated hard surfaces, and to formulations for the treatment of hard surfaces comprising the at least one polymer, at least one surfactant and at least one carboxylic acid and/or sulfonic acid and/or inorganic acid, and to the use of these formulations for the treatment of hard surfaces.

11 Claims, No Drawings

USE OF POLYMERS FOR MODIFYING SURFACES IN CLEANING APPLICATIONS

The present invention relates to the use of formulations comprising at least one polymer for the treatment of hard surfaces as compositions for improving the run-off behavior of water from the treated hard surfaces and for reducing soil and salt deposition on the treated hard surfaces, and to formulations for the treatment of hard surfaces comprising at least one polymer, at least one surfactant and at least one carboxylic acid and/or sulfonic acid and/or inorganic acid, and to the use of these formulations for the treatment of hard surfaces.

For the cleaning of hard surfaces, in particular of smooth surfaces such as glass or ceramic, besides a high cleaning performance, simple and convenient application, and streak-free and rapid drying, it is desirable for water to run off from the abovementioned cleaned surfaces in the form of a thin film of water so that the formation of dried-on traces of water on these surfaces is avoided. Furthermore, easier soil release, e.g. of lime residues, is desired. Welting with water on the hard surfaces takes place, for example, in the bathroom during and after showering or bathing, where the formation of dried-on traces of water can also be observed. These traces of water arise in particular due to the water hardness in the form of traces of lime and rims of lime. In the bathroom, and also in other areas, e.g. in areas with floor coverings which form hard surfaces, rapid and streak-free drying, as well as easier soil release, are further desired. For the automatic washing or handwashing of dishes too, many of the above-mentioned properties are desired. Furthermore, the formation of dried-on water drops is a problem when cleaning window glass, for example when the cleaned window is then subjected to a rain shower.

It is therefore desirable to provide formulations for the treatment of hard surfaces which are particularly suitable for equipping hard surfaces with one or more of the abovementioned properties for a period of more than one wetting cycle.

WO 96/04358 discloses glass cleaning compositions which avoid a troublesome degree of film formation and/or streaking and thus impart a desirable appearance to the glass surface. This desirable appearance is maintained over a prolonged period, which is achieved by the glass cleaners comprising a material which imparts greater hydrophilicity to the glass. This material is preferably polycarboxylates, for example poly(vinylpyrrolidone/acrylic acid), polyacrylic acid or sulfonated polystyrene polymers.

DE-A 198 59 777 relates to aqueous liquid surfactant-containing cleaners for hard surfaces, in particular glass, which comprise lignosulfonate. The lignosulfonate in the cleaners at the same time achieves a so-called antirain effect (avoidance of dried-on traces of water) and an antimisting effect (avoidance of the condensation of water on the hard surfaces).

Compared with the formulations for treating hard surfaces which are known from the prior art, it is desirable to further improve the properties of the formulations for the treatment of hard surfaces, in particular for smooth surfaces such as glass, metal, ceramic or plastic, i.e. to provide compositions which have a desirable combination of the abovementioned properties, where at least some of these properties are retained over a period of more than one wetting cycle.

We have found that this object is achieved through the use of formulations comprising a) at least one polymer as component A comprising at least one structural unit of the formula (I)

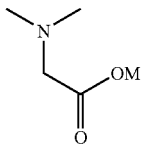

(I)

where the structural unit may be part of a polymer main chain or may be bonded to a polymer main chain via an anchor group, and M is hydrogen or a metal cation;

and water;

for the treatment of hard surfaces as compositions for improving the run-off behavior of water from the treated hard surfaces and for reducing soil and salt deposition on the treated hard surfaces.

Surprisingly, it has been found that formulations which comprise the specified polymers (component A) have excellent properties with regard to the run-off behavior of water of surfaces treated with the formulations and with regard to soil and salt deposition on the treated surfaces. As a result, rapid and streak-free drying, the avoidance or reduction in the condensation of water and/or the formation of dried-on traces of water and easier soil release are achieved.

Hard surfaces are understood as meaning all known hard surfaces. These are, in particular, smooth surfaces, for example surfaces made of glass, ceramic, metal, e.g. stainless steel, enamel, painted surfaces and plastic. Preferably, the formulations according to the present application are used for the treatment of glass or ceramic.

Treatment is understood as meaning either a pre- or after-treatment of the hard surfaces before or after cleaning, or else treatment during cleaning. Furthermore, the treatment of the hard surfaces can take place independently of a cleaning operation.

For the purposes of the present application, the expression "treatment of hard surfaces" is understood as meaning the "bringing into contact" of the formulations used according to the invention with the hard surface. The "bringing into contact" can take place by rinsing, spraying, wiping or immersion or other methods known to the person skilled in the art.

The polymers (component A) used in the formulations used according to the invention are characterized by ecologically favorable properties. In the natural environment, for example in sewage plants, all of the polymers precipitate out or are surface-absorbed. This behavior is also referred to as bioelimination and is regarded by the person skilled in the art as being ecologically favorable.

The polymers (component A) used in the formulations used according to the invention can be used simply on their own, as a single component in aqueous solution, in the formulations for treating hard surfaces.

Component A is present in the formulations used according to the invention generally in an amount of from 0.01 to 40% by weight, preferably 0.05 to 20% by weight, particularly preferably 0.1 to 5% by weight.

The pH of the formulations used according to the invention is dependent on the components used in the formulations and their amounts. In general, the pH in the formulations is 1 to 14, preferably 1 to 8, particularly preferably 1 to 6. In order to set an acidic pH (pH<7), the formulations used according to the invention can comprise at least one carboxylic acid and/or sulfonic acid and/or inorganic acid besides component A and water. Suitable carboxylic acids are carboxylic acids which comprise 1 to 6 carbon atoms, which may be mono-, di- or polycarboxylic acids. Examples of suitable carboxylic acids are formic acid, acetic acid, glycolic acid, lactic acid, citric acid, succinic acid and adipic acid, preferably acetic acid, citric acid and lactic acid, very particularly preferably acetic acid or citric acid. Examples of suitable sulfonic acids are amidosulfonic acid and methanesulfonic acid, preferably amidosulfonic acid. Suitable inorganic acids are, for example, hydrochloric acid and phosphoric acid. If an at least one carboxylic acid and/or sulfonic acid and/or inorganic acid is present in the formulations used according to the invention, its content is preferably 0.01 to 5% by weight, particularly preferably 0.02 to 3% by weight, very particularly preferably 0.05 to 1% by weight.

In a further embodiment of the present application, besides the at least one polymer comprising at least one structural unit of the formula I (component A), the formulations comprise at least one surfactant as component B.

Besides the at least one polymer comprising at least one structural unit of the formula I (component A) and the at least one surfactant (component B), the composition can comprise further components C to G, which are usually used in cleaners for hard surfaces. The components B to G listed below are generally present in the composition according to the invention in amounts known to the person skilled in the art.

Particular preference is therefore given to the use according to the invention of formulations comprising the following components:

a) at least one water-soluble or water-dispersible compound as in the present application, as component A;
b) at least one surfactant chosen from the group consisting of anionic, nonionic, amphoteric and cationic surfactants, as component B;
c) if appropriate at least one water-soluble organic solvent, as component C;
d) if appropriate ammonia and/or at least one alkanolamine, as component D:
e) if appropriate at least one carboxylic acid and/or sulfonic acid and/or inorganic acid, as component E;
f) if appropriate at least one builder, as component F;
g) if appropriate further auxiliaries and additives, as component G; and
h) water.

Particular preference is given to the use of formulations as defined above which comprise no metal oxides and/or metal salts.

Particular preference is given to the use of formulations comprising the following components:

a) 0.01 to 40% by weight, preferably 0.05 to 20% by weight, particularly preferably 0.1 to 5% by weight, of component A;
b) 0.01 to 80% by weight, preferably 0.01 to 30% by weight, particularly preferably 0.01 to 20% by weight, very particularly preferably 0.01 to 5% by weight, of component B:
c) 0 to 50% by weight, preferably 0.1 to 30% by weight, particularly preferably 0.5 to 15% by weight, very particularly preferably 1 to 10% by weight, of component C:
d) 0 to 5% by weight, preferably 0.01 to 3% by weight, preferably 0.02 to 1% by weight, particularly preferably 0.05 to 0.5% by weight, of component D;
e) 0 to 5% by weight, preferably 0.01 to 5% by weight, particularly preferably 0.02 to 3% by weight, very particularly preferably 0.05 to 1% by weight, of component E;
f) 0 to 10% by weight, preferably 0.1 to 5% by weight, particularly preferably 0.1 to 3% by weight, of component F;
g) 0 to 5% by weight, preferably 0.01 to 3% by weight, of component G; and
h) as the remainder, water, where the total amount of components A to G and water is 100% by weight.

The amounts given above refer to ready-to-use formulations. Ready-to-use formulations are understood as meaning aqueous solutions which are applied to the surface in a manner typical of the surface, e.g. by wiping, spraying, immersion or rinsing or similar methods as are customarily used for the treatment of objects with hard surfaces. However, the present invention also relates to the use of concentrates, i.e. formulations comprising the abovementioned components A to G, but no water or less water than stated above, which means that components A to G are present in higher concentrations. The concentrations of components A to G in the presence of no or little water as stated above can be ascertained easily by the person skilled in the art on the basis of the abovementioned amounts. The present application further relates to the use of formulations comprising components A to G which are in powder, granule, paste or gel form.

Corresponding auxiliaries and additives, and also processes for the preparation of the formulations used according to the invention in the various forms, are known to the person skilled in the art.

The effects of rapid and streak-free drying, avoidance of or reduction in the condensation of water and/or the formation of dried-on traces of water on the hard surfaces and/or easier soil release which are achieved with the help of the formulations used according to the invention due to the improved run-off behavior of water and reduced soil and salt deposition generally last over a prolonged period and more than one rewetting cycle. As a result, the cleaning, for example soil release, in cleaning cycles becomes easier following treatment with the composition according to the invention. This is achieved by the surface of the hard surfaces being modified (hydrophilized) for a prolonged period. As a result, improved run-off behavior of water in the form of a thin film and at the same time lesser soil and salt deposition on the hard surfaces are achieved.

Component A

The at least one polymer used as component A and comprising at least one structural unit of the formula (I)

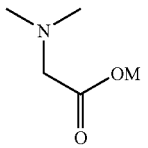

(I)

where this structural unit may be part of a polymer main chain or may be bonded to a polymer main chain via an anchor group, and M is hydrogen or an ammonium or metal cation, is disclosed in WO 2004/001099. WO 2004/001099 relates to complexing agents for the treatment of metal and plastic surfaces. For the purposes of WO 2004/001099, the treatment of metal and plastic surfaces is understood as meaning the passivation, in particular phosphation, of metal surfaces, the pickling of metal surfaces, the sizing of metal surfaces, and metal deposition on metal surfaces, for example by nickel plating, zinc plating, tin plating, copper plating or alloy deposition. Furthermore, the compositions disclosed according to WO 2004/001099 and comprising a polymer according to component A of the present invention can be used for producing coatings or rust converters. Furthermore, the compositions according to WO 2004/001099 can be used to deposit metals on plastic surfaces, for example during the manufacture of printed circuit boards. The compositions according to WO 2004/001099 can moreover be used as cleaning, pickling and polishing formulations. According to WO 2004/001099, the polymers used as component A according to the present invention are used in WO 2004/001099 in a completely different technical field to that in the present application. As the examples of WO 2004/001099 show, the compositions comprising polymers according to component A of the present invention are used for chemical or electrochemical metal deposition or for the electrolytic cleaning of metal surfaces.

It is not evident from WO 2004/001099 that formulations comprising a polymer comprising at least one structural unit of the formula (I) (component A) of the present invention serve as compositions for improving the run-off behavior of water from hard surfaces treated with said formulations and for reducing soil and salt deposition on hard surfaces treated with said formulations.

For the purposes of the present application, polymer main chain is understood as meaning the longest chain forming the polymer. This chain is constructed from carbon atoms arranged adjacent to one another as a result of covalent bonds, although this carbon chain may be interrupted by heteroatoms, in particular nitrogen, silicon or oxygen. Furthermore, this chain can have branches which are likewise constructed of carbon atoms and, if appropriate, nitrogen and oxygen atoms.

An anchor group is understood as meaning a group which links the structural unit of the formula (I) to the polymer main chain. Such anchor groups may be alkylene groups having 1 to 14 carbon atoms which may be interrupted by heteroatoms, in particular nitrogen or oxygen. These anchor groups can be bonded to carbon atoms or to heteroatoms in the polymer main chain.

In general, M in the structural unit of the formula (I) is hydrogen or an alkali metal cation, preferably a sodium or potassium ion. However, it is also conceivable that M is a di- or polyvalent cation, preferably an alkaline earth metal cation or Zn, Mn or Cr(III).

The weight-average molecular weight of the polymers used as component A is generally 200 to 10 000 000 g/mol, preferably 1000 to 3 000 000 g/mol, particularly preferably 2000 to 1 300 000 g/mol. The weight average was ascertained here by means of light scattering.

Component A is particularly preferably polymers which comprise one or more repeat units of the formulae (II), (III) and/or (IV), and/or one or two end groups of the formula (V), and if appropriate further units according to formula (VI).

(II)

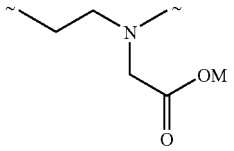

-continued (III)

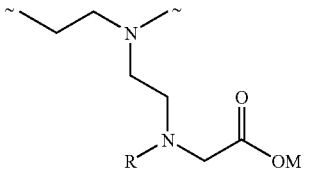

(IV)

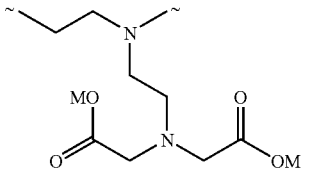

(V)

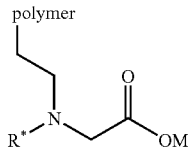

(VI)

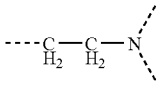

where

R is hydrogen or any substituted or unsubstituted organic radical, preferably H or radicals based on ethyleneimine such as $(CH_2CH_2NR^*)_n$—H R* is hydrogen or —$CH_2$—$CO_2M$ M is hydrogen or an ammonium or metal cation, suitable metal cations generally being alkali metal cations, preferably sodium or potassium ions, or alkaline earth metal cations, n is the number of repeat units depending on the weight-average molecular weight of the polymer, polymer is any polymer which is suitable for binding the structural unit defined in formula (V).

The polymers used in the formulations used according to the invention are generally water-soluble.

Component A is very particularly preferably water-soluble, carboxyalkylated, amino-containing polymers. These can be obtained by reacting water-soluble, amino-containing polymers with at least one aldehyde and one alkali metal cyanide or a cyanohydrin from an aldehyde and an alkali metal cyanide in aqueous solution. Suitable water-soluble, amino-containing polymers are all water-soluble compounds which contain a basic NH group. Compounds of this type are, for example, polyalkylenepolyamides. Examples thereof are polyalkylenepolyamines which have at least four basic nitrogen atoms, such as tetraethylenepentamine, pentaethylenehexamine, hexaethyleneheptamine and polyethylenediamines.

Of the polyalkylenepolyamines, preference is given to polyethyleneimines. These have particularly preferable molar masses of from 200 to 10 000 000, very particularly preferably 1000 to 3 000 000 (weight-average molecular weight). Particular preference is given to using polyethyleneimines with molar masses of from 2000 to 1 300 000.

Chemically modified polyethyleneimines can also be subjected to a carboxyalkylation. Such modified polyethyleneimines are, for example, alkylated polyethyleneimines. They are known and are prepared, for example, by reacting polyethyleneimines with alkylating agents such as alkyl halides (cf. U.S. Pat. No. 3,251,778 and EP-B 0 379 161). A further alkylating agent is, for example, dimethyl sulfate. The degree of alkylation of the polyethyleneimines is generally 1 to 50%, preferably 1 to 10%. Degree of alkylation is understood as meaning the percentage of alkylated monomer units in the polymer, based on the total number of monomer units in the polyethyleneimine. Suitable alkyl halides are, for example, $C_{1-30}$-alkyl halides.

Further suitable modified polyethyleneimines are reaction products of polyethyleneimines with $C_{2-22}$-epoxides. These reaction products are usually prepared by alkoxylation of polyethyleneimines in the presence of bases as catalyst.

Sulfonated and phosphonomethylated polyethyleneimines are also suitable. They can be prepared from the polyethyleneimines by sulfonation or phosphonomethylation, respectively.

The polymers used for the preparation of component A, preferably polyalkyleneamines, particularly preferably polyethyleneimines, can be partially crosslinked prior to the carboxyalkylation with at least bifunctional crosslinkers which have a halohydrin, glycidyl, aziridine or isocyanate unit or a halogen atom as functional groups. "Partially crosslinked" is understood as meaning that, after the crosslinking, free amino groups which are suitable for the carboxyalkylation are present in the polymers.

The present application further provides the use according to the invention where, for the preparation of the component A, polyalkylenepolyamides, preferably polyalkylenepolyamines, are used which are partially crosslinked with at least bifunctional crosslinkers which have a halohydrin, glycidyl, aziridine or isocyanate unit or a halogen atom as functional groups.

Suitable crosslinkers are, for example, epihalohydrins, preferably epichlorohydrin, and α,ω-bis(chlorohydrin)polyalkylene glycol ethers and the α,ω-bis(epoxides) of polyalkylene glycol ethers obtainable therefrom by treatment with bases. The chlorohydrin ethers are prepared, for example, by reacting polyalkylene glycol with epichlorohydrin in the molar ratio 1 to at least 2 to 5. Suitable polyalkylene glycols are, for example, polyethylene glycol, polypropylene glycol and polybutylene glycols, and block copolymers of $C_2$- to $C_4$-alkylene oxides. The average molar masses ($M_w$) of the polyalkylene glycols are generally 100 to 6000, preferably 300 to 2000 g/mol. α,ω-Bis(chlorohydrin)polyalkylene glycol ethers are described, for example, in U.S. Pat. No. 4,144,123. As is likewise disclosed therein, the corresponding bisglycidyl ethers of polyalkylene glycols are formed from the dichlorohydrin ethers by treatment with bases.

Further suitable crosslinkers are α,ω-dichloropolyalkylene glycols, as are disclosed, for example, in EP-A 0 025 515. These α,ω-dichloropolyalkylene glycols are obtainable either by reacting di- to tetrahydric alcohols, preferably alkoxylated di- to tetrahydric alcohols, with thionyl chloride with the elimination of HCl and subsequent catalytic decomposition of the chlorosulfonated compounds with the elimination of sulfur dioxide, or by converting them using phosgene to the corresponding bischlorocarboxylic esters with the elimination of HCl and from these then obtaining α,ω-dichloroethers by catalytic decomposition with the elimination of carbon dioxide.

The di- to tetrahydric alcohols are preferably ethoxylated and/or propoxylated glycols which are reacted with 1 to 100, in particular 4 to 40, mol of ethylene oxide per mole of glycol.

Further suitable crosslinkers are α,ω- or vicinal dichloroalkanes, for example 1,2-dichloroethane, 1,2-dichloropropane, 1,3-dichloropropane, 1,4-dichlorobutane and 1,6-dichlorohexane. Further suitable crosslinkers are the reaction products of at least trihydric alcohols with epichlorohydrin to give reaction products which have at least two chlorohydrin units. For example, the polyhydric alcohols used are glycerol, ethoxylated or propoxylated glycerols, polyglycerols with 2 to 15 glycerol units in the molecule, and optionally ethoxylated and/or propoxylated polyglycerols. Crosslinkers of this type are known, for example, from DE-A 29 16 356. Also suitable are crosslinkers which contain blocked isocyanate groups, for example trimethylhexamethylene diisocyanate blocked with 2,2,3,6-tetramethylpiperidin-4-one. These crosslinkers are known, for example, from DE-A 40 28 285. Furthermore, crosslinkers containing aziridine units and based on polyethers or substituted hydrocarbons, for example 1,6-bis-N-aziridinohexane, are suitable. According to the present application, the crosslinkers can be used individually or as mixtures of two or more crosslinkers.

The crosslinkers used are particularly preferably epihalohydrins, preferably epichlorohydrin, α,ω-bis(chlorohydrin) polyalkylene glycol ethers, α,ω-bis(epoxides) of polyalkylene glycol ethers and/or bisglycidyl ethers of polyalkylene glycols.

The polymers, preferably the polyalkyleneamines, particularly preferably polyethyleneimines, are crosslinked with said crosslinkers by processes known to the person skilled in the art. In general, the crosslinking takes place at a temperature of from 10 to 200° C., preferably 30 to 100° C. The reaction is usually carried out at atmospheric pressure. The reaction times are dependent on the polyalkyleneamines and crosslinkers used. In general, the reaction time is 0.5 to 20 hours, preferably 1 to 10 hours. The crosslinker is generally added in aqueous solution, meaning that the reaction usually takes place in aqueous solution. The resulting product can be isolated or be reacted directly—without isolation step—in the carboxyalkylation, which is preferred.

The crosslinked polymers, preferably polyalkyleneamines, obtained after crosslinking the polymers, preferably the polyalkyleneamines, contain free amino groups which can be reacted in the subsequent carboxyalkylation.

The carboxyalkylation generally takes place by reacting the water-soluble, amino-containing optionally partially crosslinked polymers with an aldehyde, preferably formaldehyde, and an alkali metal cyanide, preferably sodium cyanide. It is, however, also possible to use a cyanohydrin from an aldehyde and an alkali metal cyanide, for example glycol nitrite, which is formed by the addition reaction of sodium cyanide onto formaldehyde.

Preference is given to using carboxymethylated polyethyleneimines as component A. These are preferably obtained by carboxymethylation of polyethyleneimines with formaldehyde and sodium cyanide.

The carboxyalkylation of the water-soluble, optionally crosslinked, amino-containing compounds is preferably carried out until 1 to 100% of the NH groups in amino-containing polymers are carboxyalkylated. The aldehyde and the alkali metal cyanide are particularly preferably used in an amount such that 50 to 100% of the NH groups in the amino-containing polymers are carboxyalkylated. The degree of the preferably carried out carboxymethylation is usually 60 to 100%, based on the NH groups in the polymer.

Processes for the preparation of the water-soluble amino-containing polymers, particularly preferably for the preparation of carboxyalkylated polyethyleneimines, very particularly preferably for the preparation of carboxymethylated polyethyleneimines, used preferably as component A are disclosed in WO 97/40087.

In a preferred embodiment, the water-soluble or water-dispersible polymers (component A) are prepared by a process comprising the steps:

i) partial crosslinking of polymers, preferably of polyalkyleneamines, particularly preferably polyethyleneimines, as described above,
   with
   at least bifunctional crosslinkers which have a halohydrin, glycidyl,
   aziridine or isocyanate unit or a halogen atom as functional group;

and ii) carboxyalkylation of the crosslinked amino-containing compounds with an aldehyde, preferably formaldehyde and an alkali metal cyanide, preferably sodium cyanide or with a cyanohydrin.

Step i)

The crosslinking of the polymers, preferably polyalkyleneamines, particularly preferably polyethyleneimines, with said crosslinkers takes place by processes known to the person skilled in the art. In general, the crosslinking is carried out at a temperature of from 10 to 200° C., preferably 30 to 100° C. The reaction is usually carried out at atmospheric pressure. The reaction times are dependent on the polyalkyleneamines and crosslinkers used. In general, the reaction time is 0.5 to 20 hours, preferably 1 to 10 hours. The crosslinker is generally added in aqueous solution, meaning that the reaction usually takes place in aqueous solution. The resulting product can be isolated or be reacted directly—without isolation step—in the carboxyalkylation, which is preferred. Suitable polymers are the polymers specified above.

Step ii)

The carboxyalkylation of the crosslinked amino-containing compounds takes place by processes known to the person skilled in the art, for example as disclosed in WO 97/40087. In a preferred embodiment, the carboxyalkylation is carried out by simultaneously adding aldehyde and alkali metal cyanide to an aqueous solution of the crosslinked amino-containing polymer, for example within from 0.5 to 10 hours, preference being given to a slight excess of alkali metal cyanide in the reaction mixture. For example a small amount of alkali metal cyanide is initially introduced in the reaction mixture, for example 2 to 10 mol % and then formaldehyde and alkali metal cyanide in a molar ratio of about 1:1 are added either separately or in the form of a mixture. One mole of aldehyde and one mole of alkali metal cyanide reacts per mole of NH groups in the crosslinked polymer containing amino groups. If a lower degree of carboxyalkylation is desired, then, based on one mole of NH groups, it is possible to use a molar deficit of from 0.01 to 1 mol of aldehyde and 0.01 to 1 mol of alkali metal cyanide. The carboxyalkylation can be carried out continuously or batchwise or semicontinuously. Further suitable process conditions of the carboxyalkylation are disclosed, for example, in WO 97/40087.

Besides component A and water, the formulations used according to the invention can comprise further components B to G.

Component B

The formulations used according to the invention comprise 0.01 to 80% by weight, preferably 0.01 to 30% by weight, particularly preferably 0.01 to 20% by weight, very particularly preferably 0.01 to 5% by weight, of at least one surfactant chosen from the group consisting of anionic, nonionic, amphoteric and cationic surfactants, as component B.

Suitable anionic surfactants are, for example, fatty alcohol sulfates of fatty alcohols having 8 to 22, preferably 8 to 18, carbon atoms, e.g. $C_9$-$C_{11}$-alcohol sulfates, $C_{12}$-$C_{13}$-alcohol sulfates, $C_{14}$-$C_{18}$-alcohol sulfates, such as lauryl sulfate, cetyl sulfate, myristyl sulfate, palmityl sulfate, stearyl sulfate or tallow fatty alcohol sulfate.

Further suitable anionic surfactants are sulfated ethoxylated $C_8$-$C_{22}$-alcohols (alkyl ether sulfates) and soluble salts thereof. Compounds of this type are prepared, for example, by firstly alkoxylating a $C_{8-22}$-, preferably $C_{10-18}$-alcohol, e.g. a fatty alcohol, and then sulfating the alkoxylation product. For the alkoxylation, preference is given to using ethylene oxide, using 2 to 50, preferably 2 to 30, mol of ethylene oxide per mole of fatty alcohol. The alkoxylation of the alcohols may, however, also be carried out with propylene oxide on its own and if appropriate butylene oxide. Also suitable are those alkoxylated $C_{8-22}$-alcohols which contain ethylene oxide and propylene oxide or ethylene oxide and butylene oxide. The alkoxylated $C_{8-22}$-alcohols can contain the ethylene oxide, propylene oxide and butylene oxide units in the form of blocks or in random distribution.

Further suitable anionic surfactants are alkanesulfonates, such as $C_8$-$C_{24}$-, preferably $C_{10}$-$C_{18}$-alkanesulfonates, and soaps, such as the Na and K salts of $C_8$-$C_{24}$-carboxylic acids.

Further suitable anionic surfactants are $C_8$-$C_{20}$-linear alkylbenzenesulfonates (LAS), preferably linear $C_9$-$C_{13}$-alkylbenzenesulfonates and -alkyltoluene-sulfonates.

Further suitable anionic surfactants are $C_8$-$C_{24}$-olefinsulfonates and -disulfonates, which may also represent mixtures of alkene- and hydroxyalkanesulfonates or -disulfonates, alkyl ester sulfonates, sulfonated polycarboxylic acids, alkyl glycerol sulfonates, fatty acid glycerol ester sulfonates, alkylphenol polyglycol ether sulfates, paraffin sulfonates having 20 to 50 carbon atoms (based on paraffin or paraffin mixtures obtained from natural sources), alkyl phosphates, acyl isethionates, acyl taurates, acyl methyltaurates, alkylsuccinic acids, alkenylsuccinic acids or half-esters or half-amides thereof, alkylsulfosuccinic acids or amides thereof, mono- and diesters of sulfosuccinic acids, acyl sarcosinates, sulfated alkyl polyglycosides, alkyl polyglycol carboxylates and hydroxyalkyl sarcosinates.

Suitable anionic surfactants are also alkyl phosphates.

The anionic surfactants can be added to the formulations used according to the invention in the form of salts. Suitable salts are alkali metal salts, such as sodium, potassium, lithium salts and ammonium salts, such as hydroxyethylammonium, di(hydroxyethyl)ammonium and tri(hydroxyethyl)ammonium salts.

The anionic surfactants can be used individually or in combination of different anionic surfactants, and in a mixture with the other specified surfactants. It is possible to use anionic surfactants from only one class, e.g. only fatty alcohol sulfates or only alkylbenzenesulfonates, or else mixtures from different classes, e.g. a mixture of fatty alcohol sulfates and alkylbenzenesulfonates.

Preferred anionic surfactants are alkyl ether sulfates, alkyl sulfates and alkyl phosphates.

Suitable nonionic surfactants are, for example, alkoxylated $C_8$-$C_{22}$-alcohols, such as fatty alcohol alkoxylates or oxo alcohol alkoxylates. The alkoxylation can be carried out with ethylene oxide, propylene oxide and/or butylene oxide. Surfactants which can be used here are all alkoxylated alcohols which contain at least two added molecules of an abovementioned alkylene oxide. Also suitable here are block copolymers of ethylene oxide, butylene oxide and/or propylene oxide, or addition products which contain said alkylene oxides in random distribution. 2 to 50 mol, preferably 3 to 20 mol, of at least one alkylene oxide is used per mol of alcohol. Preference is given to using ethylene oxide as alkylene oxide. The alcohols preferably have 10 to 18 carbon atoms.

A further class of suitable nonionic surfactants are alkylphenol ethoxylates with $C_6$-$C_{14}$-alkyl chains and 5 to 30 mol of ethylene oxide units.

A further class of nonionic surfactants are alkyl polyglucosides having 8 to 22, preferably 10 to 18, carbon atoms in the alkyl chain. These compounds mostly contain 1 to 20, preferably 1.1 to 5, glucoside units. A further class of nonionic surfactants is N-alkylglucamides.

Suitable nonionic surfactants are also alkylamine alkoxylates or alkylamide ethoxylates.

Preferably, the formulations used according to the invention and having 3 to 12 mol of ethylene oxide comprise ethoxylated $C_{10}$-$C_{16}$-alcohols, particularly preferably ethoxylated fatty alcohols. Preference is also given to alkyl polyglucosides, alkylamine alkoxylates and amide ethoxylates.

It is possible to use individual nonionic surfactants or a combination of different nonionic surfactants or a mixture with further specified surfactants. Preference is given to using alkoxylated $C_8$-$C_{22}$-alcohols on their own.

Typical examples of amphoteric surfactants are alkylbetaines, alkylamidobetaines, aminopropionates, aminoglycinates or amphoteric imidazolium compounds.

Preferred examples are cocoamphocarboxypropionate, cocoamidocarboxy-propionic acid, cocoamphocarboxyglycinate and cocoamphoacetate.

Suitable cationic surfactants are substituted or unsubstituted, straight-chain or branched quaternary ammonium salts, e.g. $C_{8-6}$-dialkyldimethylammonium halides, dialkoxydimethylammonium halides or imidazolium salts with a long-chain alkyl radical.

As component B, very particular preference is given to using anionic surfactants, nonionic surfactants or combinations of anionic and nonionic surfactants. With very particular preference, component B is chosen from fatty alcohol sulfates, alkyl ether sulfates, fatty alcohol alkoxylates and mixtures thereof.

Component C

The water-soluble organic solvent (component C) is generally used in an amount of from 0 to 50% by weight, preferably 0.1 to 30% by weight, particularly preferably 0.5 to 15% by weight, very particularly preferably 1 to 10% by weight, in the formulations used according to the invention.

Suitable water-soluble organic solvents are $C_1$-$C_6$-alcohols and/or ether alcohols, preference being given to mixtures of different alcohols and/or ether alcohols.

Suitable alcohols are ethanol, isopropanol and n-propanol. Ethylene glycol, propylene glycol and glycerol are also suitable. Suitable ether alcohols are ether alcohols having up to 10 carbon atoms in the molecule, for example ethylene glycol monobutyl ether, propylene glycol monobutyl ether, diethylene glycol monobutyl ether, propylene glycol mono-tert-butyl ethers and propylene glycol monoethyl ethers. Particular preference is given to ethylene glycol monobutyl ether and propylene glycol monobutyl ether. With very particular preference, component C is chosen from ethanol, isopropanol, n-propanol, ethylene glycol monobutyl ethers, propylene glycol monobutyl ethers and mixtures of two or more of the specified water-soluble organic solvents.

If alcohol and ether alcohol are used in the mixture, then the weight ratio of alcohol and ether alcohol is preferably 1:2 to 4:1. In mixtures of two different ether alcohols, preferably ethylene glycol monobutyl ether and propylene glycol monobutyl ether, the weight ratio is preferably 1:6 to 6:1, particularly preferably 1:5 to 5:1, very particularly preferably 4:1, where particularly preferably the content of ether alcohol having fewer carbon atoms is the higher of the two.

Components D and E

Ammonia and/or at least one alkanolamine (component D) are used in an amount of, in general, 0 to 5% by weight, preferably 0.01 to 3% by weight, particularly preferably 0.02 to 1% by weight, very particularly preferably 0.05 to 0.5% by weight.

As component D, preference is given to using ammonia and/or alkanolamines which contain 1 to 9 carbon atoms in the molecule. As alkanolamines, preference is given to using ethanolamines, particularly preferably monoethanolamine.

Besides the ammonia and/or the at least one alkanolamine, or in place of ammonia and/or the at least one alkanolamine, the formulations used according to the invention can comprise at least one carboxylic acid and/or sulfonic acid and/or inorganic acid. Suitable carboxylic acids are carboxylic acids which contain 1 to 6 carbon atoms, which may be mono-, di- or polycarboxylic acids. Examples of suitable carboxylic acids are formic acid, acetic acid, glycolic acid, lactic acid, citric acid, succinic acid and adipic acid, preferably acetic acid, citric acid and lactic acid, very particularly preferably acetic acid and citric acid. Examples of suitable sulfonic acids are amidosulfonic acid and methanesulfonic acid, preferably amidosulfonic acid. Examples of suitable inorganic acids are hydrochloric acid and phosphoric acid.

The at least one carboxylic acid and/or sulfonic acid and/or inorganic acid (component E) is used in an amount of, in general, 0 to 5% by weight, preferably 0.01 to 5% by weight, particularly preferably 0.02 to 3% by weight, very particularly preferably 0.05 to 1% by weight.

Component F

The at least one builder is used in an amount of, in general, 0 to 10% by weight, preferably 0.1 to 5% by weight, particularly preferably 0.1 to 3% by weight.

The builders include inorganic builders and organic (co) builders.

Suitable inorganic builders are all customary inorganic builders, such as aluminosilicates, silicates, carbonates, phosphates and phosphonates.

Suitable inorganic builders are known to the person skilled in the art and disclosed, for example, in DE-A 101 60 993.

The (co)builders used are, for example, polycarboxylates. Also suitable are salts of phosphonic acids and oligomeric or polymeric polycarboxylates. Also suitable are co- and terpolymers of unsaturated $C_4$-$C_8$-dicarboxylic acids with monoethylenically unsaturated monomers, which may additionally be modified, and also polyglyoxylic acids, polyamidocarboxylic acids and modified polyamidocarboxylic acids, polyaspartic acid or cocondensates of aspartic acid with further amino acids, $C_4$-$C_{25}$-mono- or -dicarboxylic acids and/or $C_4$-$C_{25}$-mono- or -diamines, condensation products of citric acid with hydroxycarboxylic acids or polyhydroxy compounds with molar masses of, in general, up to 10 000, preferably up to 5000.

Suitable organic (co)builders are specified, for example, in DE-A 101 60 993.

Furthermore, besides components A to F, the formulations used according to the invention can comprise further auxiliaries and additives as component G.

Component G

The further auxiliaries and additives may be present in the formulations used according to the invention in an amount of from 0 to 5% by weight, preferably 0.01 to 3% by weight.

Suitable auxiliaries and additives include all auxiliaries and additives customarily used in treatments and cleaners for hard surfaces, preferably dyes, perfume oils, pH regulators, for example NaOH, preservatives, complexing agents for alkaline earth metal ions, enzymes, bleach systems, soil release polymers, foam boosters, foam suppressors or foam inhibitors, biocides, antitarnish and/or anticorrosion agents, suspension agents, fillers, inorganic standardizers, disinfectants, hydrotropic compounds, antioxidants, solubility promoters, dispersants, processing auxiliaries, solubilizers, plasticizers and antistatic substances.

Suitable auxiliaries and additives are specified, for example, in DE-A 101 60 993.

The formulations used according to the invention are generally prepared by mixing components A to G if they are present in the formulations used according to the invention, and water. Suitable mixing processes are known to the person skilled in the art.

The formulations can be used wherever improved run-off behavior of water and/or a reduction in soil and salt deposition is desirable. For example, the formulations can be used as pre- or after-treatment compositions for hard surfaces, in particular glass and ceramic, or as cleaners such as glass cleaners, floor cleaners, all-purpose cleaners, bath cleaners, rinse aids, dishwashing detergents for hand or machine dishwashing, machine cleaners, metal degreasers, high-pressure cleaners, alkaline cleaners, acidic cleaners, point degreasers, dairy cleaners etc. Preferably, the formulations are used as pre- or after-treatment compositions for hard surfaces, in particular glass and ceramic, or as cleaners such as glass cleaners, floor cleaners, all-purpose cleaners and bath cleaners.

The present application further provides formulations for the treatment of hard surfaces comprising a) 0.05 to 20% by weight, preferably 0.1 to 5% by weight, of at least one polymer as component A comprising at least one structural unit of the formula (I)

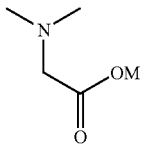

(I)

where this structural unit may be part of a polymer main chain or may be bonded to a polymer main chain via an anchor group, and M is hydrogen or a metal cation;

b) 0.01 to 30% by weight, preferably 0.01 to 20% by weight, particularly preferably 0.01 to 5% by weight, of at least one surfactant chosen from the group consisting of anionic, nonionic, amphoteric and cationic surfactants, as component B;

c) 0 to 50% by weight, preferably 0.1 to 30% by weight, preferably 0.5 to 15% by weight, particularly preferably 1 to 10% by weight, of at least one water-soluble organic solvent, as component C;

d) 0 to 3% by weight, preferably 0.02 to 1% by weight, particularly preferably 0.05 to 5% by weight, of ammonia and/or at least one alkanolamine, as component D;

e) 0.01 to 5% by weight, preferably 0.02 to 3% by weight, particularly preferably 0.05 to 1% by weight, of at least one carboxylic acid and/or sulfonic acid and/or inorganic acid, as component E;

f) 0 to 10% by weight, preferably 0.1 to 5% by weight, particularly preferably 0.1 to 3% by weight, of at least one builder, as component F;

g) 0 to 5% by weight, preferably 0.01 to 3% by weight, of further auxiliaries and additives, as component G; and h) water, so that the total amount of components A to G and water is 100% by weight.

The pH of the formulations used according to the invention is dependent on the components used in the formulations and their amounts. In general, the pH in the formulations is 1 to 14, preferably 1 to 8, particularly preferably 1 to 6.

The formulations according to the invention are suitable for the treatment of hard surfaces, where they improve the run-off behavior of water on the treated hard surfaces and can reduce the soil and salt deposition on the treated hard surfaces.

Suitable components A, B, C, D, E, F and G are the above-mentioned suitable components A to G.

The formulations according to the invention are suitable for the pre- and for the after-treatment of the hard surfaces before or after cleaning, and also for treatment during cleaning. Furthermore, the treatment of the hard surfaces with the formulations according to the invention can be carried out independently of a cleaning operation.

Suitable hard surfaces and preferred hard surfaces have already been specified above.

The formulations according to the invention can thus be used as pre- or after-treatment compositions for hard surfaces, in particular glass and ceramic, or as cleaners such as glass cleaners, floor cleaners, all-purpose cleaners, bath cleaners, rinse aids, dishwashing detergents for hand or machine dishwashing, machine cleaners, metal degreasers, high-pressure cleaners, alkaline cleaners, acidic cleaners, point degreasers, dairy cleaners etc. Preferably, the formulations according to the invention are used as pre- or after-treatment compositions for hard surfaces, in particular glass and ceramic, or as cleaners such as glass cleaners, floor cleaners, all-purpose cleaners and bath cleaners.

Depending on their intended use, the formulations according to the invention have preferably no metal oxides and/or metal salts.

The present application further provides a process for the treatment of hard surfaces, where the hard surfaces are brought into contact with the formulation according to the invention.

Suitable formulations and hard surfaces have already been specified above. The "bringing into contact" generally takes place by rinsing, immersion, spraying or wiping or other methods known to the person skilled in the art. The "bringing into contact" can be carried out as a pre- or after-treatment before or after cleaning, during cleaning or independently of a cleaning operation.

The present application further provides the use of the formulations according to the invention for the treatment of hard surfaces. The formulations according to the invention are exceptionally suitable for this intended use in particular due to their properties, namely an improvement in the run-off behavior of water and a reduction in soil and salt deposits on the hard surfaces treated with the formulations according to the invention.

The formulations according to the invention are generally prepared by mixing components A to G, if present in the formulations according to the invention, and water. Suitable mixing processes are known to the person skilled in the art.

The examples below additionally explain the invention.

EXAMPLES

A 0.5% strength solution of a carboxymethylated polyamine was prepared and adjusted to pH 4 with acetic acid. The carboxymethylated polyethyleneimine had an average molecular weight of 50 000 g/mol (determined by light scattering) and was prepared from polyethyleneimine analogously to example 1 in WO 97/40087, the degree of carboxymethylation being 80 mol %.

Novoker ceramic tiles were used for the experiments. 0.3 g of the polymer solution was placed onto each of the tiles and wiped uniformly in circles on the surface using a cloth for 30 seconds. The tile was then left to dry.

The tile was then stood vertically and sprayed with about 10.5 g of drinking water (hardness 10.4° German hardness) in 10 sprayings. The appearance of the film of water was assessed (see table 1). The tiles were then left standing to dry in the fume cupboard for 15 minutes. The appearance of the tiles after drying was likewise assessed (table 2). The entire procedure (spraying/drying) was repeated twice. For comparison, an untreated Novoker ceramic tile was likewise sprayed and assessed.

TABLE 1

| | Appearance of the film of water | | |
|---|---|---|---|
| | 1st rinse | 2nd rinse | 3rd rinse |
| With carboxymethylated polyamine | Even film | Even film | Even at the top, streaky at the bottom |
| Comparison, untreated | Runs off in streaks, drops | Runs off in streaks, drops | Runs off in streaks, drops |

TABLE 2

| | Appearance after drying | | |
|---|---|---|---|
| | 1st rinse | 2nd rinse | 3rd rinse |
| With carboxymethylated polyamine | Not visible | Slight streaking | Few water marks |
| Comparison, untreated | Considerable water marks | Considerable water marks | Considerable water marks |

Furthermore, the time required for the complete drying of the ceramic tiles treated according to the invention as stated above and the untreated ceramic tiles after one rinse operation (as stated above) was monitored (see table 3).

TABLE 3

| Time required for complete drying after one rinse operation | |
|---|---|
| | Time [s] |
| With carboxymethylated polyamine | 5-10 |
| Comparison, untreated | 10-15 |

We claim:

1. A method for improving the run-off behavior of water from hard surfaces and for reducing soil and salt deposition on hard surfaces comprising treating the hard surfaces with a composition comprising:

a) at least one polymer as component A comprising one or more repeat units of each of the formulae (II), (III) and (IV) and optionally further units according to formula (VI)

(II)

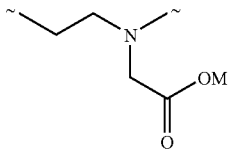

(III)

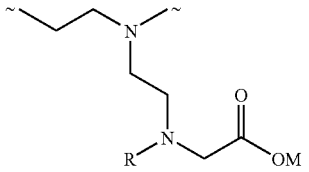

(IV)

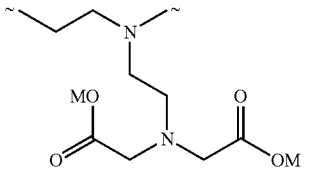

(VI)

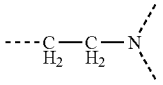

where

R is hydrogen or any substituted or unsubstituted organic radical,

M is hydrogen or an ammonium or metal cation; and water;

for the treatment of hard surfaces as compositions, wherein, for the preparation of component A, polyalkylenepolyamines are used which are partially crosslinked with at least bifunctional crosslinkers which have a halohydrin, glycidyl, aziridine or isocyanate unit or a halogen atom as functional groups.

2. The method according to claim 1, wherein the formulations comprise the following components:

a) at least one water-soluble or water-dispersible compound as in claim 1, as component A;

b) at least one surfactant chosen from the group consisting of anionic, nonionic, amphoteric and cationic surfactants, as component B;

c) if appropriate at least one water-soluble organic solvent, as component C;

d) if appropriate ammonia and/or at least one alkanolamine, as component D;

e) if appropriate at least one carboxylic acid and/or sulfonic acid and/or inorganic acid, as component E;

f) if appropriate at least one builder, as component F;

g) if appropriate further auxiliaries and additives, as component G; and h) water.

3. The method according to claim 2, wherein the formulations comprise the following components:

a) 0.01 to 40% by weight, of component A;

b) 0.01 to 80% by weight, of component B;

c) 0 to 50% by weight, of component C;

d) 0 to 5% by weight, of component D;

e) 0 to 5% by weight, of component E;

f) 0 to 10% by weight, of component F;

g) 0 to 5% by weight, of component G; and h) water, so that the total amount of components A to G and water is 100% by weight.

4. The method according to claim 1, characterized in that the weight-average molecular weight of the polymer (component A) is 200 to 10 000 000 g/mol.

5. The method according to claim 2, wherein component B is chosen from fatty alcohol sulfates, alkyl ether sulfates, fatty alcohol alkoxylates and mixtures thereof.

6. The method according to claim 2, wherein component C is chosen from ethanol, isopropanol, n-propanol, ethylene glycol monobutyl ethers, propylene glycol monobutyl ethers and mixtures of two or more of the specified water-soluble organic solvents.

7. The method according to claim 2, wherein component D is ammonia and/or monoethanolamine, and/or component E is acetic acid, citric acid, lactic acid or amidosulfonic acid.

8. A formulation for the treatment of hard surfaces comprising:

a) 0.05 to 20% by weight, of at least one polymer as component A comprising one or more repeat units of each of the formulae (II), (III) and (IV) and if appropriate further units according to formula (VI), (II)

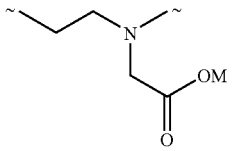

(III)

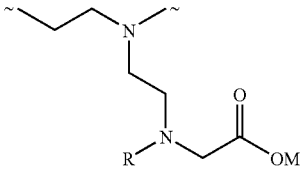

(IV)

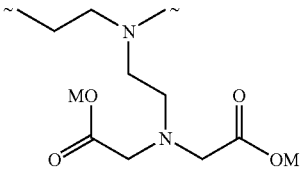

-continued (VI)

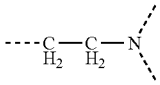

where

R is hydrogen or any substituted or unsubstituted organic radical,

M is hydrogen or an ammonium or metal cation;

b) 0.01 to 30% by weight, of at least one surfactant chosen from the group consisting of anionic, nonionic, amphoteric and cationic surfactants, as component B;

c) 0 to 50% by weight, of at least one water-soluble organic solvent, as component C;

d) 0 to 3% by weight, of ammonia and/or at least one alkanolamine, as component D;

e) 0.01 to 5% by weight, of at least one carboxylic acid and/or sulfonic acid and/or inorganic acid, as component E;

f) 0 to 10% by weight, of at least one builder, as component F;

g) 0 to 5% by weight, of further auxiliaries and additives, as component 6; and h) water, so that the total amount of components A to G and water is 100% by weight, wherein, for the preparation of component A, polyalkylenepolyamines are used which are partially crosslinked with at least bifunctional crosslinkers which have a halohydrin, glycidyl, aziridine or isocyanate unit or a halogen atom as functional groups.

9. The formulation according to claim 8, wherein the weight-average molecular weight of the polymer (component A) is 200 to 10 000 000 g/mol.

10. The formulation according to claim 8, wherein, for the preparation of component A, polyalkylenepolyamines are used which are partially crosslinked with at least bifunctional crosslinkers which have a functional group selected from the group consisting of a halohydrin, a glycidyl, an aziridine and an isocyanate.

11. The method according to claim 1, wherein, for the preparation of component A, polyalkylenepolyamines are used which are partially crosslinked with at least bifunctional crosslinkers which have a functional group selected from the group consisting of a halohydrin, a glycidyl, an aziridine and an isocyanate.

* * * * *